US011428512B1

(12) United States Patent
Pollock

(10) Patent No.: US 11,428,512 B1
(45) Date of Patent: Aug. 30, 2022

(54) PROJECTILES FOR A PAINTBALL MARKER AND SYSTEMS

(71) Applicant: A.N.S. XTREME PERFORMANCE, INC., Simi Valley, CA (US)

(72) Inventor: Adam John Pollock, Lakeside, CA (US)

(73) Assignee: A.N.S. XTREME PERFORMANCE, INC., Simi Valley, CA (US)

( * ) Notice: Subject to any disclaimer, the term of this patent is extended or adjusted under 35 U.S.C. 154(b) by 400 days.

(21) Appl. No.: 16/133,084

(22) Filed: Sep. 17, 2018

Related U.S. Application Data

(60) Provisional application No. 62/566,526, filed on Oct. 2, 2017.

(51) Int. Cl.
*F42B 6/00* (2006.01)
*F42B 8/12* (2006.01)
(Continued)

(52) U.S. Cl.
CPC ..... *F42B 6/00* (2013.01); *F42B 8/12* (2013.01); *F42B 12/02* (2013.01); *F41B 11/00* (2013.01); *F42B 10/00* (2013.01); *F42B 12/80* (2013.01)

(58) Field of Classification Search
CPC .... F42B 6/00; F42B 8/12; F42B 12/00; F42B 12/02; F42B 6/10; F42B 8/02; F42B 12/36; F42B 12/40; F42B 12/46; F42B 12/72; F42B 30/00; F42B 8/00; F42B 8/14; F42B 8/16; F42B 10/00; F42B 10/02;
(Continued)

(56) References Cited

U.S. PATENT DOCUMENTS 1,483,165 A * 2/1924 Washington ..... A63B 69/3655 D30/160
2,086,631 A * 7/1937 Munro ..... A63H 33/00 206/0.5
(Continued)

FOREIGN PATENT DOCUMENTS

DE 10116234 A1 * 1/2003 ..... F42B 10/22
DE 202015003493 U1 * 8/2015 ..... F42B 10/38
FR 2905169 A1 * 2/2008 ..... F42B 12/40

OTHER PUBLICATIONS

Adam John Pollock, PBnation Message Thread, Mar. 4, 2017, https://www.pbnation.com/showthread. php?t=5574706&highlight=atom6.

(Continued)

*Primary Examiner* — James S Bergin
(74) *Attorney, Agent, or Firm* — Buchalter; Cecily Anne O'Regan

(57) ABSTRACT

A hollow spherical projectile is constructed from a plurality of curved structural segments and has a plurality of openings. The projectile can be fired by a conventional paintball marker with a high degree of ballistic accuracy. The projectile is reusable and is fabricated from a flexible and resilient material. The outer surface of the projectile exhibits low friction, achieved by the material itself or by having a low friction coating applied. The projectile possess and transmits less kinetic energy than a conventional paintball and therefore inflicts less pain and damage upon impact. Fabrication can be accomplished by 3D printing, or molding as a single seamless piece, or as a plurality of pieces which are then assembled.

21 Claims, 3 Drawing Sheets

(51) Int. Cl.

| | |
|---|---|
| ***F42B 12/02*** | (2006.01) |
| ***F42B 10/00*** | (2006.01) |
| ***F42B 12/80*** | (2006.01) |
| ***F41B 11/00*** | (2013.01) |

(58) Field of Classification Search

CPC ..... F42B 12/76; F42B 12/80; F41B 11/00; F41B 11/89

USPC ..... 102/444, 447, 501, 502, 506, 512, 513, 102/529; 473/569, 612; D22/115, 116

See application file for complete search history.

(56) References Cited

U.S. PATENT DOCUMENTS 2,597,704 A * 5/1952 Carlson ..... B29C 66/14 156/245
3,889,950 A * 6/1975 Kasravi ..... A63H 33/18 383/117
4,696,347 A * 9/1987 Stolov ..... A62C 3/00 169/46
4,930,776 A * 6/1990 Newcomb ..... A63B 43/06 273/DIG. 20
5,224,959 A * 7/1993 Kasper ..... A63B 21/00069 446/85
5,236,196 A * 8/1993 Blankenburg ..... G09B 23/04 434/213
5,280,906 A * 1/1994 Vitale ..... A63B 43/00 273/DIG. 20
5,448,951 A * 9/1995 Olson ..... F42B 12/40 106/206.1
5,639,526 A * 6/1997 Kotsiopoulos ..... B29C 66/1226 473/577
5,640,945 A * 6/1997 Slonaker ..... F41A 21/00 124/56
5,936,190 A * 8/1999 Buzick ..... F42B 12/40 473/577
6,012,395 A * 1/2000 Saxby ..... F42B 12/745 102/444
6,145,441 A * 11/2000 Woodall ..... F42B 8/14 102/370
6,729,984 B2 * 5/2004 Silverglate ..... A63B 43/00 273/157 R
7,500,434 B2 * 3/2009 Flatau ..... F42B 10/36 102/502
7,882,786 B2 * 2/2011 DeHaan ..... F42B 12/40 102/513
D642,640 S * 8/2011 Ellis ..... D21/709
9,016,888 B2 * 4/2015 Glynn ..... H05B 41/34 362/208
2004/0005937 A1 * 1/2004 Saiz ..... A63B 37/0012 473/351
2008/0134927 A1 * 6/2008 Skellern ..... F42B 12/367 102/369
2011/0253009 A1 * 10/2011 Black ..... A63B 43/00 106/160.1
2012/0028743 A1 * 2/2012 Muldoon ..... A63B 39/00 473/612
2016/0082323 A1 * 3/2016 Higa ..... A63B 43/00 473/613
2016/0131462 A1 * 5/2016 López-Pozas Lanuza ..... F42B 10/38 473/613

OTHER PUBLICATIONS

Atomic Pickle Industries, Indiegogo, ATOM6—Fun & Flexible .68 Projectiles Campaign, Aug. 4, 2017, https://www.indiegogo.com/projects/atom6-fun-flexible-68-projectiles#/.

* cited by examiner

PROJECTILES FOR A PAINTBALL MARKER AND SYSTEMS

CROSS REFERENCE TO RELATED APPLICATION

This application claims the filing benefit under 35 U.S.C. § 119(e) of U.S. Provisional Application No. 62/566,526, filed Oct. 2, 2017, which is hereby incorporated by reference.

TECHNICAL FIELD

This invention relates to the field of paintball, a recreational activity utilizing paintball guns known as paintball markers where projectiles are fired at targets or other players. More particularly, the invention relates to a reusable and generally low mass projectile which permits use at closer ranges compared to conventional paintballs due to the invention's lower kinetic energy.

BACKGROUND OF THE INVENTION

Paintball is a popular activity where players have access to high-powered paintball markers that commonly feature aluminum construction, electronic firing modes and different options for compressed gas propellants. A conventional paintball is a single-use 3 gram projectile filled with a food grade colored pigment referred to as paint or fill. Due to the pigment and potential for physical damage, a paintball should only be fired outdoors or at an appropriate paintball facility.

A paintball fired at the generally accepted industry standard muzzle velocity of 285 feet per second (FPS) has approximately 7 pounds of energy when striking an object at a distance of 15 feet. For a player at this distance wearing light clothing this impact will often break the skin leaving a painful circular laceration in addition to a moderate to severe contusion. A paintball shot at drywall at short distances fully penetrates the material leaving a sizeable hole. Additionally, a paintball impact to other sensitive surfaces or objects such as those typically found in residential dwellings will also result in severe damage.

Players have a desire to train and use their paintball markers without the mess left by pigment filled projectiles. Additionally for economy, a reusable projectile is also desired. There are reusable projectiles available today, however their mass is similar to a conventional paintball. This means these reusable projectiles have the same damaging impact energy as a paintball and are not practical or safe for use at close ranges or indoors.

Additionally, toy guns utilizing the common foam dart are relatively safe for use indoors and have low impact energies. However, these toys feature plastic construction and possess quality and features generally known to be inferior to paintball markers. Therefore a need exists for a reusable paintless projectile that can be fired from a paintball marker that also has low kinetic energy, allowing it to be utilized at close ranges and indoors.

BRIEF SUMMARY OF THE INVENTION

A hollow projectile having a spherical shape is formed from a plurality of structural segments and has a plurality of surface openings. The projectile can be fired by a conventional paintball marker with a high degree of ballistic accuracy, and is reusable. The projectile does not require a specialized paintball marker and can be used with any marker of the correct corresponding caliber. Because of its reduced mass, the projectile possesses and transmits a lower amount of kinetic energy, and therefore inflicts less pain and damage upon impact compared to conventional paintballs and reusable paintballs. Moreover, the projectile has a reduced rebound bounce after striking a surface compared to reusable paintballs. The projectile can be fabricated by injection molding as a single seamless piece. The projectile is flexible, resilient, and durable, and possesses low surface friction.

In accordance with an embodiment, a projectile for a paintball marker includes a plurality of curved structural segments which are connected to form a hollow discontinuous sphere. The plurality of curved structural segments form a plurality of openings, and are dimensioned to be fired by the paintball marker.

In accordance with another embodiment, the hollow discontinuous sphere has a diameter of one of (1) about 0.50 inches, and (2) about 0.68 inches.

In accordance with another embodiment, the plurality of curved structural segments are fabricated from a flexible and resilient material.

In accordance with another embodiment, the plurality of curved structural segments are fabricated from one of (1) a thermoplastic elastomer, and (2) a thermoplastic rubber.

In accordance with another embodiment, the plurality of curved structural segments have a friction reducing surface.

In accordance with another embodiment, the paintball marker has a caliber. The hollow discontinuous sphere has a caliber which is slightly smaller than the caliber of the paintball marker.

In accordance with another embodiment, the plurality of curved structural segments have a combined weight of less than 3 grams.

In accordance with another embodiment, the plurality of openings includes an opening which is formed by three of the curved structural segments.

In accordance with another embodiment, the plurality of openings include an opening having a hexagonal shape.

In accordance with another embodiment, the plurality of openings include two polar openings.

In accordance with another embodiment, the polar openings have a hexagonal shape.

In accordance with another embodiment, the plurality of curved structural segments are reusable.

In accordance with another embodiment, the projectile for a paintball marker cooperates with adjacent projectiles. The plurality of openings are configured to prevent intermeshing and entanglement with the adjacent projectiles.

In accordance with another embodiment, the plurality of curved structural segments include a curved structural segment which has a varying width.

Other embodiments, in addition to the embodiments enumerated above, will become apparent from the following detailed description, taken in conjunction with the accompanying drawings, which illustrate, by way of example, the principles of the projectile for a paintball marker.

DETAILED DESCRIPTION OF THE INVENTION

Figure 1:
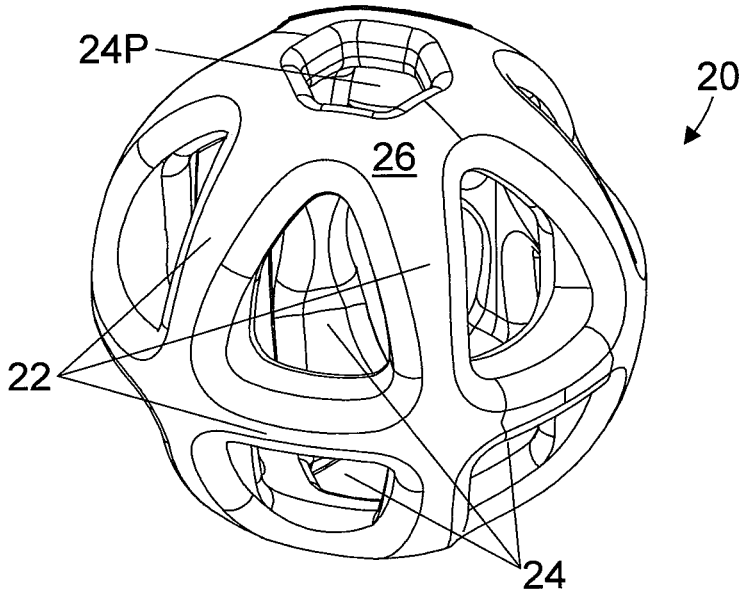
FIG. 1 is a perspective view of a projectile for a paintball marker.

Referring to FIGS. 1-6, there are illustrated several views of a projectile for a paintball marker generally designated as 20. Projectile 20 is made from a plurality of curved structural segments 22. Curved structural segments 22 are connected to form a hollow discontinuous sphere (a sphere with openings) which is dimensioned to be fired by a paintball marker (gun, not shown). The plurality of curved structural segments 22 form a plurality of openings 24. In other words, the plurality of curved structural segments 22 collectively form a spherical shell which has a plurality of apertures (openings 24). Openings 24 extend from the outside surface of curved structural segments 22 to the inside surface of curved structural segments 22.

In the shown embodiment, at the top and bottom of projectile 20 are two polar openings 24P which have a hexagonal shape. Also it is noted that in the shown embodiment some of the openings 24 are formed by three curved structural segments 22 and have a generally curved triangular shape. Additionally, the entire outer surface of the curved structural segments 22 has a low friction glossy coating 26 which is evenly applied to all curved structural segments 22. Also, the plurality of curved structural segments 22 have a combined weight which is less than 3 grams (the weight of a conventional paintball).

In more detail, referring to the preferred embodiment of the invention in FIGS. 1-6, as to be compatible for use with a conventional paintball marker the projectile 20 has an overall spherical shape which is accomplished by the collective spherical orientation of the curved structural segments 22. The curved structural segments 22 can vary in number, length, thickness, size, and shape and can be in a multitude of orientations in relation to the centerline of the projectile 20 so long as they collectively provide an interconnected spherical structure of the projectile 20. Furthermore, curved structural segments 22 can be oriented in a symmetrical fashion or non-symmetrical offset configuration so long as projectile 20 maintains weight balance and a uniform distribution of mass. In the embodiment shown in FIGS. 1-6 it is noted that curved structural segments 22 have a varying width. That is, the curved structural segments 22 downwardly taper from the poles to the equator of projectile 20.

Additionally still referring to FIGS. 1-6, for the present projectile 20 to be compatible with conventional paintball markers it must also resist intermeshing and entanglement of curved structural segments 22 with other adjacent like projectiles 20. Entangled is to be understood as any resistance of one projectile 20 to physically separate itself from an adjacent like projectile 20 under the force of gravity alone. Additionally, intermeshing is to be understood as the surface of a projectile 20 to significantly penetrate inward and beyond the surface of another like projectile 20. The potential for intermeshing with other projectiles 20 often occurs in the hopper, magazine, breech or other location within the paintball marker or its accessories where a plurality of like projectiles 20 commingle. The potential for intermeshing also extends to when projectiles 20 are in retail or bulk packaging as well as in storage containers. If projectiles 20 become intermeshed and entangled with one another this can cause jams and hinder proper loading of the projectiles 20 in paintball markers.

The present projectile 20 prevents intermeshing by minimizing the overall size of all surface openings 24 and polar openings 24P as not to permit the curved structural segments 22 of adjacent projectiles to penetrate deep enough into the projectile so as to become entangled. The need to minimize the size and orientation of surface opening 24 and polar openings 24P as to prevent intermeshing and entanglement is balanced with the counter requirements of minimizing total mass and having polar openings 24P of sufficient size as to permit fabrication by injection molding in a single piece as described in detail below. In view of the above, the plurality of openings 24 defined by curved structural segments 22 are configured to prevent intermeshing and entanglement with adjacent projectiles 20.

Figure 2:
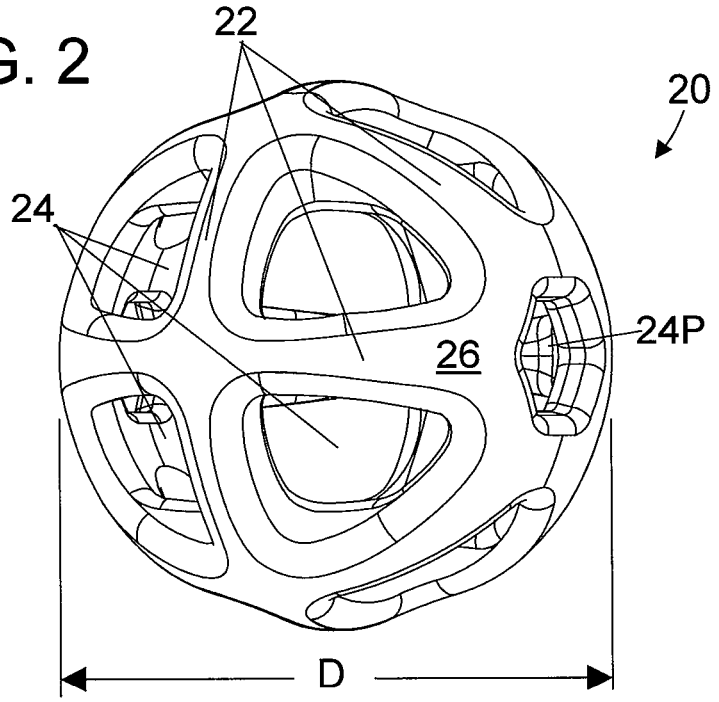
FIG. 2 is another perspective view of the projectile for a paintball marker.
Figure 3:
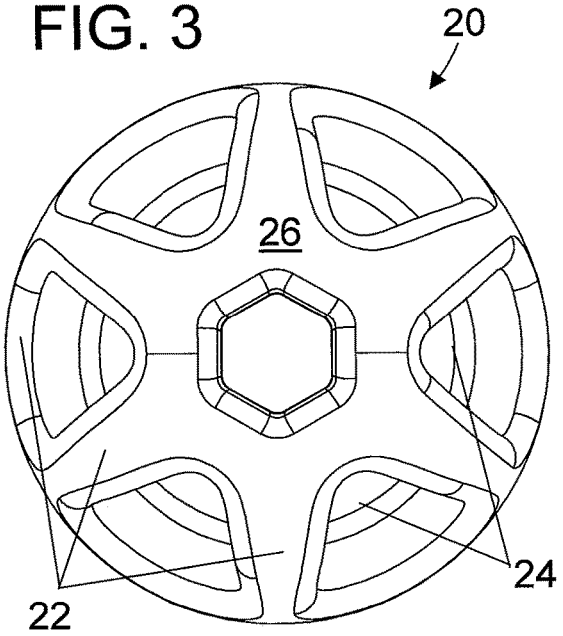
FIG. 3 is a top plan view of the projectile for a paintball marker.
Figure 5:
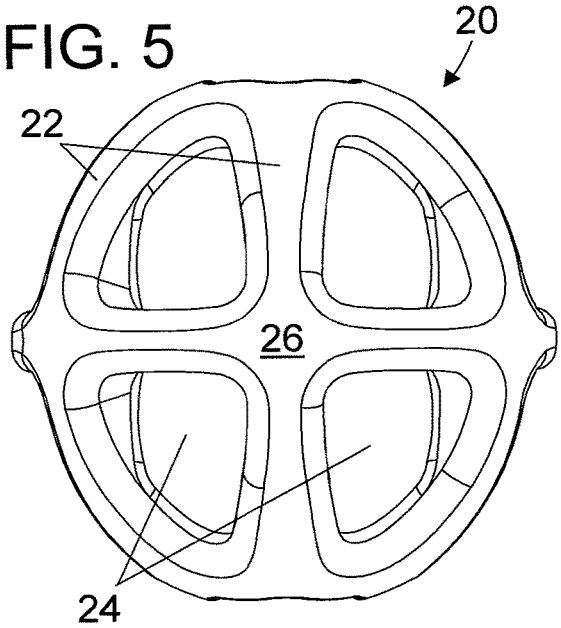
FIG. 5 is a front elevation view of the projectile for a paintball marker.
Figure 4:
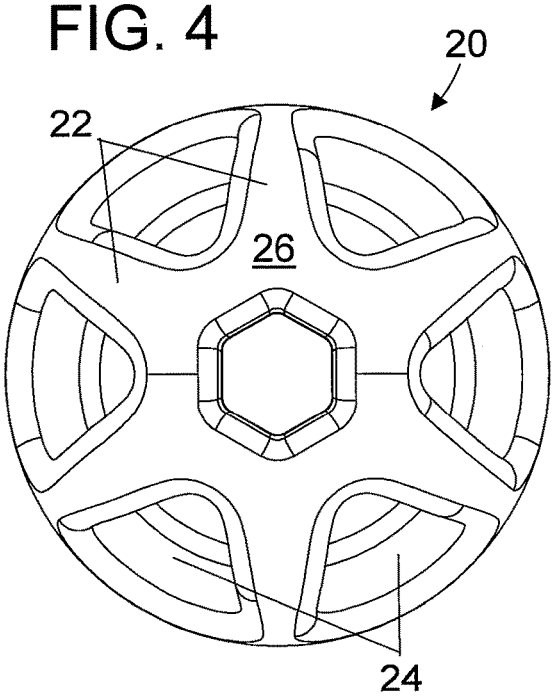
FIG. 4 is a bottom plan view of the projectile for a paintball marker.
Figure 6:
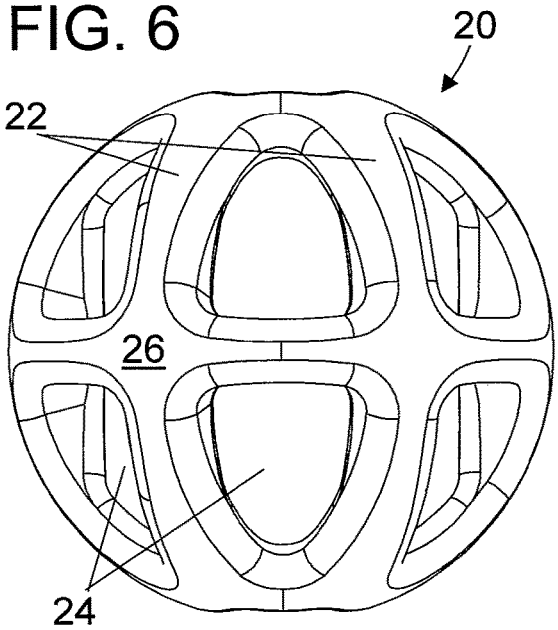
FIG. 6 is a side elevation view of the projectile for a paintball marker; and, FIG. 7 is a perspective view of another embodiment of the projectile for a paintball marker.

Referring to FIG. 2, for the present invention to be compatible with conventional paintball markers the diameter D of the hollow discontinuous sphere formed by the plurality of structural segments 22 (the external diameter of the sphere) must be appropriate for the given caliber of paintball marker to be used. In an embodiment of projectile 20, the diameter D of the hollow discontinuous sphere formed by curved structural segments 22 is one of (1) about 0.68 inches (.68 caliber) and (2) about 0.50 inches (.50 caliber). While these are the most common projectile sizes for paintball markers today, the diameter D of the present projectile 20 is not to be limited to these two aforementioned diameters.

It is also significant to note that the preferred embodiment of the present projectile 20 is made of a flexible material and its shape can become deformed while in the breech and barrel of a paintball marker due to acceleration forces when being fired. As a result, diameters D of the present projectile 20 can be made slightly smaller than the caliber for the given paintball marker as to permit sufficient buffer space to account for the expansion and distortion of the flexible projectile 20 as it accelerates when fired. That is, in an embodiment the hollow discontinuous sphere formed by curved structural segments 22 has a caliber which is slightly smaller than the caliber of the paintball marker. In other words, the diameter D of projectile 20 is slightly smaller than the bore of the paintball marker.

The thickness of curved structural segments 22 can differ in alternative embodiments to provide a lighter or heavier projectile 20 which directly affects maximum range and amount of kinetic energy. The thickness of curved structural segments 22 has no impact on the diameter D of the projectile 20 since increased structural segment 22 thickness extends inwardly into the hollow spherical structure rather than outwardly.

For the projectile 20 to further achieve the goal of being compatible as well as useful with conventional paintball markers it has a high degree of ballistic accuracy when fired. This is accomplished primarily by the plurality of surface openings 24 and polar openings 24P which permit the passage of air through the projectile 20 as it travels through the air. This passage of air through the surface openings 24 and polar openings 24P increases spin which serves to stabilize the projectile 20 in flight. Additionally, the surface openings 24 and polar openings 24P reduce aerodynamic drag by allowing a portion of the oncoming stationary air to pass through the projectile 20. This reduces the compression forces that are present on the leading side of the spherical projectile 20 as it travels through oncoming air. Leading side compression forces can act to push and deflect a projectile's trajectory and is a reason why firearms today favor streamlined pointed projectiles instead of musket balls (solid spheres). Furthermore surface openings 24 and polar openings 24P produce turbulent pockets of air at their boundaries that promote the adhesion of a laminar air flow around the projectile and delay its separation compared to a solid smooth spherical projectile. In this way the surface openings 24 and polar openings 24P of the present projectile 20 work in a similar fashion to dimples on a golf ball, improving accuracy and reducing drag.

Additionally, the preferred embodiment of the present projectile 20 shown in FIGS. 1-6 achieves further compatibility with conventional paintball markers by having a low friction surface coating 26 which is applied directly and evenly to all curved structural segments 22. If the projectile 20 has too much surface friction it can become jammed in the firing bolt of the paintball marker, as well as cause undesired jams elsewhere in the marker or accessories. In the preferred embodiment, the projectile 20 has a clear glossy low friction finish applied evenly to the surface by spraying. In alternate embodiments a material can be used for the curved structural segments 22 that itself possesses low surface friction and therefore does not require the application of a supplemental low friction coating material. This is to include fabricating the present invention by any molding technique, 3D printing or any other practical method.

Still referring to FIGS. 1-6, for the present projectile 20 to be reusable the material used for curved structural segments 22 must be resilient enough to sustain the pressures and impact of being repeatedly fired from a paintball marker. As such, curved structural segments 22 are preferable fabricated from a flexible material. Thermoplastic elastomers (TPE) or thermoplastic rubbers (TPR) are examples of materials that can be used for curved structural segments 22 in the preferred embodiment of the projectile 20, but should not be construed as the only materials with which the present projectile 20 can be constructed.

Additionally, to be reusable the present projectile 20 should be able to withstand the force of a human stepping on it and similar abuse, and have the ability to return to or retain its original shape thereafter. When the present projectile 20 is made using a flexible material it is the result of a combination of the resilience of the material used in conjunction with surface openings 24 and polar openings 24P which allow the projectile 20 to be compressed under pressure without structural failure, then return to its normal shape after. Additionally, the projectile 20 in the preferred embodiment has the ability to be washed clean of dirt or debris as needed using plain water which further supports the projectile's ability to be reused.

It is a primary goal of the present projectile 20 to inflict less damage to objects and less pain to players who are struck by the projectile 20 at close ranges compared to conventional paintballs and reusable paintballs. This is achieved by limiting the overall mass of the projectile 20, which is done in the present invention by having a hollow internal structure. Low mass is further achieved by having a multitude of surface openings 24 and polar openings 24P which further reduce the total material and mass of the projectile 20. The thickness and corresponding mass of the curved structural segments 22 can be adjusted to achieve a desired total weight for the projectile 20. Additionally, the size and number of all surface openings 24 and polar openings 24P can also be adjusted to achieve a desired total mass for the projectile 20.

The material used for the projectile 20 also helps achieve the goal of inflicting less damage and injury. By utilizing a flexible material for the curved structural segments 22, a portion of the impact energy is absorbed and dissipated into and around the projectile 20 rather than being transmitted directly into the impacted surface. When a flexible material is used for the curved structural segments 22, the surface openings 24 and polar openings 24P also serve to further dampen and absorb impact energy by providing additional space for adjacent curved structural segments 22 to flex into unhindered. This is similar to engineered "crumple zones" in modern automobiles which permit the expansion and distortion of structural materials during an impact which in turn provides absorption and dissipation of impact energy as it is transmitted through the structure.

The present projectile 20 further achieves the goal of inflicting less damage and pain compared to conventional paintballs and reusable paintballs by minimizing the velocity and distance the projectile 20 will travel when rebounding off a surface it has struck. This rebound or secondary bounce has the ability to strike additional objects or players and inflict damage. A conventional paintball typically will not have a rebound or secondary bounce since it usually destructs upon impact. However, rebound is a major issue with conventional reusable paintballs which are often solid rubber-like spheres. The present projectile 20 in its preferred embodiment reduces rebound by having hollow construction and curved structural segments 22 comprised of a flexible material which together absorb and disperse impact energy into and around the projectile 20. This dispersion is further aided by structural openings 24 and polar openings 24P by providing additional space for curved structural segments 22 to expand and flex into. As impact energy is dispersed the total amount of energy the projectile possesses is reduced, therefore reducing the energy available for propelling a secondary bounce. Less energy available for the secondary bounce means the projectile 20 will travel a shorter distance and at a lower velocity after striking a surface and therefore have less potential to inflict damage or injury during a secondary bounce.

While the material used to comprise the projectile 20 in the preferred embodiment is flexible, it should be known that alternative embodiments can have differing degrees of flexibility, or no flexibility at all. The popularity of magazine fed paintball markers, known as magfed is growing. Instead of a hopper where projectiles are held above the marker before being funneled into the breech, magfed markers utilize a magazine below the marker where projectiles are stored under spring compression and fed upwards. To be compatible with a magfed paintball marker, a projectile must possess enough resilience to withstand this spring compression without having its shape or structure compromised. An alternate embodiment of the present invention is a hollow spherical projectile 20 where structural segments are comprised of a rigid material, or material of limited flexibility as to be able to withstand the spring compression and be compatible with magfed markers.

The present projectile 20 can utilize a material for the curved structural segments 22 that can optionally have glow properties or be reflective to ultraviolet black lights as to increase enjoyment and visibility in low light conditions.

Yet another primary goal of the present projectile 20 is to allow for the injection molding of the projectile 20 in one seamless piece. This is made possible by the existence of the polar openings 24P, and it being of sufficient size and positioned at the top of the projectile 20. The injection mold cavity which shapes the hollow inside of the spherical projectile 20 then has sufficient clearance to be extracted from the finished projectile after it has been molded without damaging or destroying the projectile 20. Two identical polar openings 24P are found on the projectile for symmetry and balance of mass, while only one is used for the extraction and separation of the mold cavity from the projectile 20.

The benefits of fabricating the projectile 20 in one piece include no seams or otherwise weak points of the structure which may have a higher probability of failure compared to the rest of the structure. Additionally, if the projectile 20 is fabricated in multiple pieces, these must then be assembled by gluing, hot plate fusing or other method to produce the final singular projectile 20. These additional assembly steps can add cost, complexity and labor to the fabrication process as well as add weight and structural weaknesses to the final projectile 20.

While injection molding the present projectile 20 as a single piece is the preferred embodiment, the scope of the present projectile 20 is to extend to include other means of fabrication. Alternate fabrication methods include but are not limited to molding the projectile 20 in multiple pieces which are then assembled together. 3D printing is another common fabrication method to create the present invention and variations thereof. In both of these alternate fabrication methods the projectile 20 no longer requires polar openings 24P to serve the functional purpose of removing the mold cavity, so they can be absent or of different size and/or configuration. When molding the projectile 20 in multiple pieces (such as two halves) then assembling, the curved structural segments 22 are to be made of sufficient width and girth as to support the existence of registration structures (male/female) as well as ample surface area for adhesive or fusing of the projectile 20 parts. In this configuration the width and girth of curved structural segments 22 may vary within the same projectile 20 to facilitate assembly at the center line but taper towards the poles as to limit overall mass.

Figure 7:
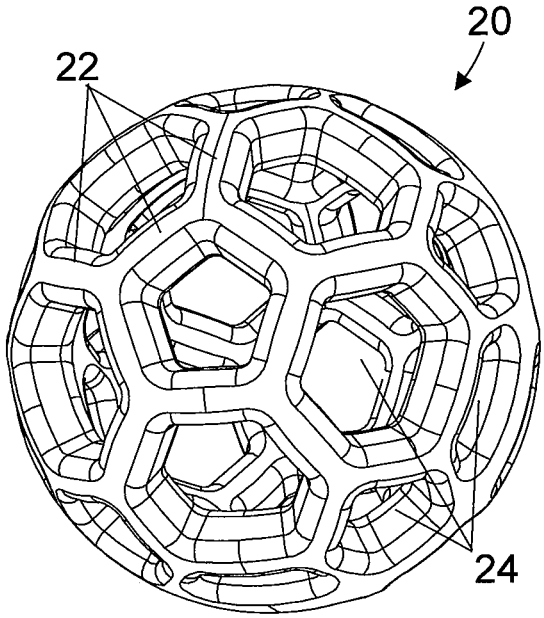

FIG. 7 shows another alternate embodiment of the present projectile 20. Curved structural segments 22 are more numerous and at varying orientations compared to the preferred embodiment of FIGS. 1-6. Additionally the polar openings 24P and surface openings 24 are smaller and more numerous compared to the preferred embodiment of FIGS. 1-6. In this embodiment, surface openings 24 and polar openings 24P have a hexagonal shape. The projectile 20 shown in FIG. 7 possess higher mass due to the increased amount of curved structural segment 22 volume and their corresponding collective mass. The functionality of the projectile 20 and advantages discussed herein remain unchanged with this alternate embodiment.

The advantages of the present projectile 20 include without limitation, the ability for the projectile 20 to be compatible with and useful with conventional paintball markers. Further the present projectile 20 inflicts less damage to objects and surfaces and less pain to players compared to conventional paintballs and reusable paintballs. Also the present projectile 20 provides a high degree of ballistic accuracy, further increasing its usefulness with conventional paintball markers. Additionally the present projectile 20 is reusable and in its preferred embodiment does not have the mess of conventional pigment filled paintballs. Finally, the present projectile 20 has the ability to be fabricated in a single seamless piece, by injection molding as well as 3D printing resulting in a projectile without weak points and one that can be manufactured with a minimum number of steps.

It may be appreciated that projectile 20 may be combined with a paintball marker to form a paintball gun system.

The embodiments of the projectile for a paintball marker described herein are exemplary and numerous modifications, combinations, variations, and rearrangements can be readily envisioned to achieve an equivalent result, all of which are intended to be embraced within the scope of the appended claims. Further, nothing in the above-provided discussions of the projectile should be construed as limiting the invention to a particular embodiment or combination of embodiments. The scope of the invention is defined by the appended claims.

I claim:

1. A projectile for a paintball marker comprising:

a hollow discontinuous sphere defining a void having a first hemisphere and a second hemisphere sized for use with the paintball marker; and a plurality of curved structural segments defining a plurality of curved triangular openings into the void in either the first hemisphere or the second hemisphere, and a first hexagonal opening in the first hemisphere and a second hexagonal opening in the second hemisphere.

2. The projectile for the paintball marker according to claim 1 wherein the hollow discontinuous sphere has a diameter of one of (1) about 0.50 inches, and (2) about 0.68 inches.

3. The projectile for the paintball marker according to claim 1 wherein the plurality of curved structural segments are fabricated from a flexible and resilient material.

4. The projectile for the paintball marker according to claim 3 wherein the plurality of curved structural segments are fabricated from one of (1) a thermoplastic elastomer, and (2) a thermoplastic rubber.

5. The projectile for the paintball marker according to claim 1 wherein the plurality of curved structural segments have a friction reducing surface.

6. The projectile for the paintball marker according to claim 1, the paintball marker having a caliber, wherein the hollow discontinuous sphere has a caliber which is slightly smaller than the caliber of a paintball marker.

7. The projectile for the paintball marker according to claim 1 wherein the plurality of curved structural segments have a combined weight of less than 3 grams.

8. The projectile for the paintball marker according to claim 1, wherein the plurality of curved structural segments are reusable.

9. The projectile for the paintball marker according to claim 1, wherein the plurality of openings of the projectile are configured to prevent intermeshing and entanglement with an adjacent projectile.

10. The projectile for the paintball marker according to claim 1 wherein the plurality of curved structural segments include a curved structural segment with a varying width.

11. The projectile for the paintball marker according to claim 1, the projectile for a paintball marking further comprises:

the hollow discontinuous sphere having a diameter of one of (1) about 0.50 inches, and (2) about 0.68 inches;

the plurality of curved structural segments fabricated from a flexible and resilient material;

the plurality of curved structural segments having a friction reducing surface;

the hollow discontinuous sphere having a caliber which is slightly smaller than the caliber of the paintball marker; and the plurality of curved structural segments having a combined weight of less than 3 grams.

12. A paintball gun system comprising:

a paintball marker;

a projectile for the paintball marker comprising:

a hollow discontinuous sphere defining a void having a first hemisphere and a second hemisphere; and a plurality of curved structural segments defining a plurality of curved triangular openings into the void from either the first hemisphere or the second hemisphere, and a first hexagonal opening in the first hemisphere and a second hexagonal opening in the second hemisphere;

wherein the projectile has a diameter of one of (1) about 0.50 inches, and (2) about 0.68 inches and is dimensioned to be fired by the paintball marker.

13. The paintball gun system according to claim 12 wherein the plurality of curved structural segments fabricated from a flexible and resilient material.

14. The paintball gun system according to claim 13 wherein the plurality of curved structural segments fabricated from one of (1) a thermoplastic elastomer, and (2) a thermoplastic rubber.

15. The paintball gun system according to claim 12 wherein the plurality of curved structural segments having a friction reducing surface.

16. The paintball gun system according to claim 12 wherein the paintball marker has a caliber; and the hollow discontinuous sphere has a caliber smaller than the caliber of the paintball marker.

17. The paintball gun system according to claim 12 wherein the plurality of curved structural segments having a combined weight of less than 3 grams.

18. The paintball gun system according to claim 12 wherein the plurality of curved structural segments being reusable.

19. The paintball gun system according to claim 12 wherein the plurality of openings are configured to prevent intermeshing and entanglement with the adjacent projectiles.

20. The paintball gun system according to claim 12 wherein the plurality of curved structural segments include a curved structural segment which has a varying width.

21. The paintball gun system according to claim 12 wherein the plurality of curved structural segments are fabricated from a flexible and resilient material; the plurality of curved structural segments having a friction reducing surface; the paintball marker having a caliber; the hollow discontinuous sphere having a caliber which is slightly smaller than the caliber of the paintball marker; and the plurality of curved structural segments having a combined weight of less than 3 grams.

* * * * *